US009845627B2

(12) United States Patent
Loggen et al.

(10) Patent No.: US 9,845,627 B2
(45) Date of Patent: Dec. 19, 2017

(54) HINGE FOR A PARTITION ELEMENT, IN PARTICULAR FOR A SWING DOOR

(71) Applicant: KL-Beschlage Karl Loggen GmbH, Eitorf (DE)

(72) Inventors: Jorg Loggen, Windeck (DE); Martin Frielingsdorf, Werkhausen (DE); Siggi Wistoff, Jocksdorf/Neisse-Malxetal (DE)

(73) Assignee: KL-Beschlage Karl Loggen GmbH, Eitorf (DE)

( * ) Notice: Subject to any disclaimer, the term of this patent is extended or adjusted under 35 U.S.C. 154(b) by 9 days.

(21) Appl. No.: 15/024,342

(22) PCT Filed: Sep. 23, 2014

(86) PCT No.: PCT/EP2014/070285
§ 371 (c)(1),
(2) Date: Mar. 23, 2016

(87) PCT Pub. No.: WO2015/044154
PCT Pub. Date: Apr. 2, 2015

(65) Prior Publication Data

US 2016/0215548 A1 Jul. 28, 2016

(30) Foreign Application Priority Data

Sep. 24, 2013 (DE) ..... 10 2013 219 201

(51) Int. Cl.
*E05D 15/54* (2006.01)
*E05D 5/02* (2006.01)
*E05D 11/10* (2006.01)

(52) U.S. Cl.
CPC ..... *E05D 15/54* (2013.01); *E05D 5/0246* (2013.01); *E05D 11/1014* (2013.01); *E05D 11/1064* (2013.01)

(58) Field of Classification Search
CPC ..... E05D 11/1064; E05D 11/1014; E05D 5/0246; E05D 2011/1092; E05D 7/081; Y10T 16/534; Y10T 16/2771; E05F 3/20
See application file for complete search history.

(56) References Cited

U.S. PATENT DOCUMENTS 6,526,627 B2 * 3/2003 Chiang ..... E05D 5/0246 16/280
6,766,561 B1 * 7/2004 Cheng ..... E05D 5/0246 16/235

(Continued)

FOREIGN PATENT DOCUMENTS

| | | |
|---|---|---|
| DE | 8902547 U1 | 7/1990 |
| DE | 202011000307 U1 | 5/2011 |
| WO | 2010043660 | 4/2010 |

OTHER PUBLICATIONS

International Preliminary Report on Patentability, PCT/EP2014/07285, WIPO. dated Mar. 29, 2016.

*Primary Examiner* — Justin Rephann
(74) *Attorney, Agent, or Firm* — Hodgson Russ LLP

(57) ABSTRACT

The invention concerns a strap hinge (1) for a separating element. The separating element takes the form of a door, for example, in particular a swing door. The strap hinge (1) comprises two active units. The strap hinge (1) is provided with securing units (27 to 29), which are actively connected to a surface owing to a radial movement. The strap hinge further comprises pressure units (40, 43). The strap hinge (1) offers the same properties as a strap hinge which is provided with a hydraulic braking device.

22 Claims, 4 Drawing Sheets

(56) References Cited

U.S. PATENT DOCUMENTS

| | | | | |
|---|---|---|---|---|
| 6,966,150 | B2 * | 11/2005 | Chiang | E05D 5/0246 16/252 |
| 7,305,796 | B2 * | 12/2007 | Chiang | E05D 5/0246 16/252 |
| 8,539,643 | B2 * | 9/2013 | Hung | E05F 3/12 16/252 |
| 8,572,807 | B2 * | 11/2013 | Walhorn | E05D 5/0246 16/235 |
| 8,720,005 | B2 * | 5/2014 | Cheng | E05D 5/0246 16/252 |
| 9,140,043 | B2 * | 9/2015 | Chang | E05D 5/0246 |
| 2005/0144757 | A1 * | 7/2005 | Chiang | E05D 5/0246 16/252 |
| 2010/0199459 | A1 * | 8/2010 | Bacchetti | E05D 5/0246 16/54 |
| 2012/0216370 | A1 * | 8/2012 | Chow | E05D 5/0246 16/54 |
| 2014/0075718 | A1 * | 3/2014 | Bacchetti | E05F 3/104 16/54 |

* cited by examiner

HINGE FOR A PARTITION ELEMENT, IN PARTICULAR FOR A SWING DOOR

The invention relates to a hinge for a partition element. The partition element is designed, for example, in the form of a door, in particular in the form of a swing door. The hinge is suitable, in particular, for partition elements made of glass. Furthermore, it is also possible for the hinge to be used in a window. The invention also relates to a partition system having a partition element and a hinge.

A swing door, also referred to as a swinging door, is used nowadays in a wide variety of different settings. It is distinguished in that it opens in the direction of two sides. In other words, the swing door has at least three positions, that is to say two open positions and a third position, in which the swing door is closed (also referred to as the closed position). Hinges are used in order for the swing door to be arranged on a wall. The prior art discloses a hinge which is intended for a swing door and has a first hinge part and a second hinge part. The first hinge part and the second hinge part are connected to one another for hinge action around a hinge-pin unit. The first hinge part serves for arranging the swing door on the hinge. For this purpose, clamping units are provided on the first hinge part, a door leaf of the swing door being retained with clamping action between said clamping units. The second hinge part is usually arranged on a wall, in particular on a wall of a house or building, or on a door frame.

The aforementioned positions are defined, in the case of the known hinge, by a latching device. The two open positions and the closed position are each assigned a latching position of the latching device. In the latching position, the swing door is retained in the respective position. In order to pass from one of the two open positions into the closed position, the swing door is moved from this open position into the closed position. So that the swing door, when being closed, remains in the closed position and a swinging movement, that is to say movement of the swing door from this open position to the closed position and subsequent continued movement of the swing door from the closed position to the next open position, is kept within viable limits until the closed position is definitively achieved, it is known to use hinges which, for the purpose of braking the movement of the swing door, are provided with a braking device.

For the purpose of braking the movement of the swing door, it is known from the prior art for a hinge to be provided with a hydraulic braking device. The hydraulic braking device is used, in the case of the known hinge, to brake a swinging movement of the swing door, and therefore the swing door, during a closing operation, can be arranged quickly and straightforwardly in the closed position without there being any possibility of numerous over-swing movements, that is to say movement beyond the desired position, during the closing operation. In the case of the hydraulic braking device, however, forces are transmitted by hydraulic fluid. The hydraulic fluid used is usually in the form of mineral oils. So that the hydraulic fluid does not escape, provision is made, in the case of the known hinge, for structural units which contain the hydraulic fluid to be provided with good sealing. For this purpose, however, high outlay is usually necessary. This results in high production costs. In the case of the known hinge malfunctioning, there is also a risk of the hydraulic fluid escaping from the hinge.

The invention is therefore based on the object of specifying a hinge which is intended for a partition element, in particular a swing door, and has essentially the same braking properties as a hinge with a hydraulic braking device, albeit without use being made of a hydraulic fluid.

This object is achieved according to the invention by a hinge having the features of claim 1. A partition-element system according to the invention is achieved by the features of claim 20.

The hinge according to the invention is provided for a partition element. The partition element is designed, for example, in the form of a door, in particular in the form of a swing door. Particular embodiments of the invention provide for the partition element to be formed from glass. Accordingly, the invention is preferably used for a glass door, in particular a glass swing door. However, the invention is not restricted to being used for doors. Rather, the hinge according to the invention can be used for any suitable partition element, therefore also for a window.

The hinge according to the invention has at least a first hinge part and at least a second hinge part. The first hinge part and the second hinge part are connected to one another for hinge action around at least one hinge-pin unit. The hinge-pin unit is basically the pin around which the first hinge part rotates relative to the second hinge part. The hinge-pin unit may be designed with more than one part. The invention is therefore not restricted to single-part hinge-pin units running between the first hinge part and the second hinge part.

The partition element is usually arranged on the first hinge part. For this purpose, the first hinge part has, for example, clamping units. In the case of particular embodiments, provision is made for the first hinge part to have a first clamping unit and a second clamping unit, between which the partition element is retained with clamping action.

The hinge according to the invention also has at least one latching device. The latching device itself has at least one latching body and at least one latching recess. The latching body is arranged on the first hinge part. The latching recess is arranged on the circumference of a pin body of the second hinge part. The pin body is, for example, part of the hinge-pin unit or forms the hinge-pin unit in its entirety. In a latching position of the hinge, the latching body engages in the latching recess. The latching position defines a predeterminable state of the partition element. For example, the latching position is the closed position of the partition element. However, the invention is not restricted to the use of a single latching position. Rather, in the case of further embodiments, provision is made for at least one further latching position, which defines, for example, an open position of the partition element. In the case of yet a further embodiment of the invention, in turn, yet a further latching position is provided, and therefore the hinge has a total of three positions (a closed position and two open positions). The partition element remains in these latching positions, that is to say in one of the two open positions or in the closed position.

In the case of the hinge according to the invention, provision is made for the latching body to be arranged on a piston unit. The piston unit is arranged in a movable manner in a piston-unit holder of the first hinge part. In particular, in the case of one embodiment of the invention, provision is made for the piston-unit holder to be arranged on a carrying body of the first hinge part. The carrying body is usually inserted into a cutout of the partition element, in order thus to support, and to retain, the partition element.

At least one arresting unit is arranged on the piston unit of the hinge according to the invention. The arresting unit is designed for movement in the direction of a surface of the piston-unit holder such that the arresting unit interacts with the surface of the piston-unit holder. This will be discussed in more detail herein below.

Furthermore, at least one groove is arranged on the hinge according to the invention. At least one pressure-exerting unit is arranged, in turn, in the groove. An adjusting unit is arranged, in turn, on the pressure-exerting unit itself, and this makes it possible to adjust a force by which the pressure-exerting unit is arranged in the groove. It is noted explicitly that arrangement of the adjusting unit on the pressure-exerting unit does not mean exclusively direct arrangement of the adjusting unit on the pressure-exerting unit (that is to say direct abutment of the adjusting unit against the pressure-exerting unit). Rather, the invention also covers an arrangement such that a component is arranged between the adjusting unit and the pressure-exerting unit.

The hinge according to the invention has two active units (also referred to as functional units). The first active unit is the arresting unit. The arresting unit achieves in particular two effects. On the one hand, the abutment and the interaction of the arresting unit with the surface of the piston-unit holder achieves the situation where movement of the partition element, for example movement in the direction of the closed position, is braked; on the other hand, a position of the partition element, for example a closed position of the partition element is reliably retained. In other words, the arresting unit ensures that the partition element, when being moved from a first position (for example an open position) into a second position (for example a closed position), is braked and is then brought reliably into the latching position (which defines, for example, the closed position). The second active unit is the pressure-exerting unit. This serves likewise for braking movement of the partition element and basically enhances the braking action of the first active unit.

The hinge according to the invention has the same properties as a hinge which is provided with a hydraulic braking device. The advantage, however, is that these properties are achieved without use being made of hydraulic fluid. The hinge according to the invention thus does away with in particular high-outlay sealing measures. The hinge according to the invention is easier to produce than a hinge with a hydraulic braking device.

In the case of one embodiment of the hinge according to the invention, provision is made in addition, or as an alternative, for the piston unit to have a first piston-unit end and a second piston-unit end. The latching body is arranged at the first piston-unit end. At least one piston opening is arranged at the second piston-unit end. At least one piston-spring element is arranged in the piston opening. The piston-spring element has a first spring-element end supported on the piston unit and a second spring-element end supported on the piston-adjusting unit. The piston-adjusting unit makes it possible to adjust the force by which the latching body is pushed into the latching recess in the latching position of the hinge. This makes it possible to adjust in a suitable manner the force required in order for the partition element respectively arranged on the hinge to be reliably retained in the latching position. The force can be suitably selected in particular in dependence on the weight of the partition element. The heavier the partition element, the greater should be the force which is selected.

In the case of a further embodiment of the hinge according to the invention, provision is made in addition, or as an alternative, for the piston unit to have a longitudinal axis. First of all the latching body, then the arresting unit and then the groove are arranged on the piston unit along the longitudinal axis, as seen from the first piston-unit end in the direction of the second piston-unit end.

In the case of a yet a further embodiment of the hinge according to the invention, provision is made in addition, or as an alternative, for a sleeve to be arranged in a displaceable manner on the piston unit. The sleeve has a first sleeve end and a second sleeve end. The first sleeve end is operatively connected to the arresting unit. The second sleeve end is operatively connected to the pin body. This embodiment has the advantage that, during movement of the partition element in the direction of the latching position (for example during a closing movement), the sleeve, in the region adjacent to the latching position, and/or when the latching position is reached, is displaced along the longitudinal axis of the piston unit. As a result, the arresting unit is then moved in the direction of the surface of the piston-unit holder. In particular, provision is made for the arresting unit to be moved away in the radial direction from the longitudinal axis of the piston unit such that the arresting unit butts against the surface of the piston-unit holder. This achieves, on the one hand, the braking action and, on the other hand, the arresting action.

In the case of yet a further embodiment of the hinge according to the invention, provision is made in addition, or as an alternative, for the pressure-exerting unit to be of cylindrical design and/or to be formed from stainless steel. It is noted explicitly that the invention is not restricted to a cylindrical pressure-exerting unit or to a pressure-exerting unit formed from stainless steel. Rather, it is possible to use any suitable configuration of the pressure-exerting unit. The same applies to the material from which the pressure-exerting unit is produced.

In the case of a yet a further embodiment of the hinge according to the invention, provision is made in addition, or as an alternative, for at least one elastic intermediate element to be arranged between the pressure-exerting unit and the adjusting unit. For example, the elastic intermediate element is an elastic plastics-material part. The elasticity of the elastic plastics-material part is selected such that, on the one hand, it is possible to achieve a slight movement of the pressure-exerting unit relative to the piston unit. On the other hand, the elasticity is selected such that the piston unit is reliably retained in the piston-unit holder. The elastic intermediate element enhances the braking action already explained above.

In the case of one embodiment of the hinge according to the invention, provision is made in addition, or as an alternative, for the hinge according to the invention to have not just a single pressure-exerting unit and not just a single adjusting unit for the pressure-exerting unit; rather, a plurality of pressure-exerting units and a plurality of adjusting units are provided. Thus, this embodiment of the hinge according to the invention provides for the pressure-exerting unit to be designed in the form of a first pressure-exerting unit. Furthermore, the adjusting unit is designed in the form of a first adjusting unit. Moreover, the groove is designed in the form of a first groove. Furthermore, in the case of this embodiment, provision is made for a second groove to be arranged on the piston unit. Moreover, at least a second pressure-exerting unit is arranged in the second groove. Furthermore, at least a second adjusting unit is arranged on the second pressure-exerting unit such that it is possible to adjust a force by which the second pressure-exerting unit is arranged in the second groove. As far as the arrangement of the second pressure-exerting unit on the second adjusting unit is concerned, what has already been explained above in respect of the arrangement of the (first) pressure-exerting unit on the (first) adjusting unit likewise applies.

In the case of a further embodiment of the hinge according to the invention, provision is made in addition, or as an alternative, for the first pressure-exerting unit and the second pressure-exerting unit to be arranged on an outer surface of the piston unit. In particular, provision is made for the first pressure-exerting unit and the second pressure-exerting unit to be arranged diametrically opposite to one another on the piston unit. The braking action is thus achieved from two sides of the piston unit.

In the case of yet a further embodiment of the hinge according to the invention, provision is made in addition, or as an alternative, for the arresting unit to be arranged on an outer surface of the piston unit. Moreover, provision is made, in particular, for the arresting unit to be designed in the form of a split ring. This allows, in particular, radial movement of the arresting unit from the outer surface of the piston unit in the direction of the surface of the piston-unit holder, in order thus to achieve the braking action described above.

The hinge according to the invention is not restricted to the use of a single arresting unit. Rather, numerous arresting units, for example three to five arresting units, can be used for the hinge according to the invention. The invention, however, is not restricted to this number. Rather, any suitable number of arresting units can be used. For example, the arresting unit is designed in the form of a first arresting unit. Moreover, at least a second arresting unit is arranged on the piston unit. The second arresting unit is designed for movement such that the second arresting unit interacts with the surface of the piston-unit holder. The second arresting unit has the same properties and effects as the first arresting unit.

In the case of a further embodiment of the hinge according to the invention, provision is made in addition, or as an alternative, for at least one separating element to be arranged between the first arresting unit and the second arresting unit. For example, the separating element is designed in the form of a ring. The separating element has at least a first side, which is directed toward the first arresting unit. Furthermore, a first abutment surface is arranged on the first side of the separating element. Moreover, the first abutment surface butts against a second abutment surface of the first arresting unit. Furthermore, the separating element has at least a second side, which is directed toward the second arresting unit. A third abutment surface is arranged on the second side of the separating element. The third abutment surface butts against a fourth abutment surface of the second arresting unit. In the case of yet a further embodiment, provision is made for the first abutment surface and the second abutment surface to be designed to complement one another. In addition, or as an alternative, provision is made for the third abutment surface and the fourth abutment surface to be designed to complement one another. In particular, provision is made for the first abutment surface to be designed with a radius and/or in the form of a cone, for the second abutment surface to be designed with a radius and/or in the form of a cone, for the third abutment surface to be designed with a radius and/or in the form of a cone, and/or for the fourth abutment surface to be designed with a radius and/or in the form of a cone.

The separating element makes it possible in particular to allow forces to act on the arresting units such that the latter move in the direction of the surface of the piston-unit holder. For example, they move in a radial direction away from the longitudinal axis of the piston unit as they move in the direction of the surface of the piston-unit holder.

In the case of yet a further embodiment of the hinge according to the invention, provision is made in addition, or as an alternative, for the first arresting unit to be designed in the form of a split ring, and/or for the second arresting unit to be designed in the form of a split ring. As far as the advantages are concerned, reference is made to what has been said above.

In the case of one embodiment of the hinge according to the invention, provision is made in addition, or as an alternative, for the latching body, in the latching position of the hinge, to engage resiliently in the latching recess.

In the case of yet a further embodiment of the hinge according to the invention, provision is made in addition, or as an alternative, for the latching body to have a first end and a second end. Moreover, the latching body is provided with an opening. The opening extends from the first end to the second end of the latching body. A pin element is arranged in the opening and projects both out of the first end and out of the second end of the latching body. In addition, provision is made for the pin element to be arranged on the piston unit.

In the case of a further embodiment of the hinge according to the invention, at least one hinge-pin element is arranged on the pin body. In particular, provision is made for the hinge-pin element and the pin body to be formed in one piece. For example, in the case of a further exemplary embodiment, provision is made in addition, or as an alternative, for the pin body to have two hinge-pin elements, that is to say a first hinge-pin element and a second hinge-pin element. The first hinge-pin element is arranged in a first pin holder of the second hinge part. Moreover, the second hinge-pin element is arranged in a second pin-holder of the second hinge part.

In the case of yet a further embodiment of the hinge according to the invention, provision is made in addition, or as an alternative, for the pin body to have at least one control surface. The latching recess is adjacent to the control surface, wherein the control surface is spaced apart further in the radial direction from a longitudinal axis of the pin body than a minimum distance between the latching recess and the longitudinal axis of the pin body. In other words, the latching recess is closer to the longitudinal axis than the control surface.

The invention is not restricted to the use of a single control surface. Rather, in the case of one embodiment of the hinge according to the invention, provision is made for the control surface to be designed in the form of a first control surface. The pin body then has, in addition, at least a second control surface, wherein the latching recess is likewise adjacent to the second control surface. The first control surface and the second control surface are arranged opposite one another on the pin body such that the latching recess is arranged between the first control surface and the second control surface. On the one hand, the control surface serves, or the control surfaces serve, for braking during movement of the partition element and for guiding the latching body into the latching recess. On the other hand, they serve for moving the sleeve, already mentioned above, along the longitudinal axis of the piston unit such that the arresting unit or the arresting units is or are moved radially in the direction of the surface of the piston-unit holder. The sleeve is displaced here in a direction away from the latching recess.

The invention also relates to a partition-element system having at least one partition element and having at least one hinge with at least one of the aforementioned features or a combination of at least two of the aforementioned features. Examples of a partition element have already been mentioned above. In particular, provision is made for the partition element to be designed in the form of a swing door.

The invention will now be described in more detail hereinbelow by means of figures, and with reference to an exemplary embodiment. In the figures.

Figure 1:
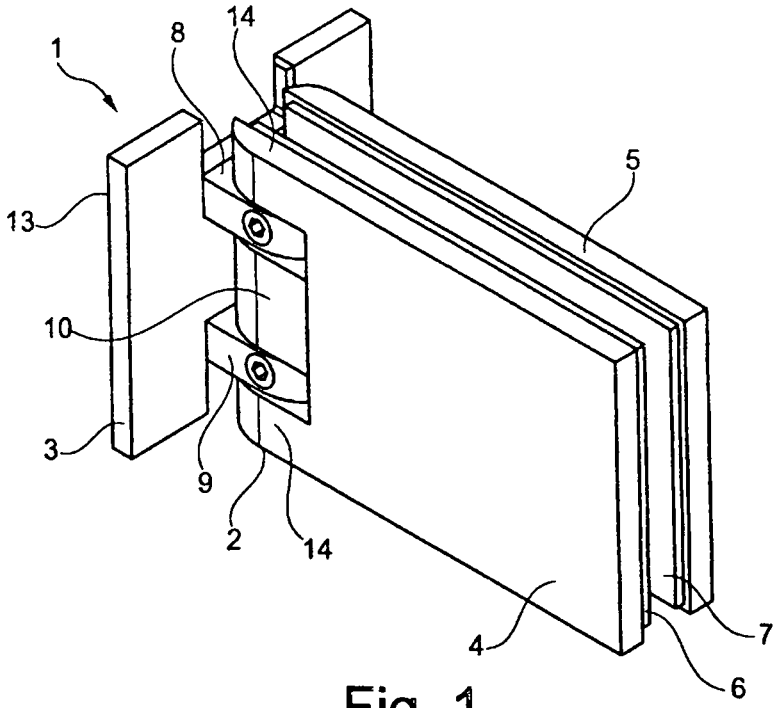
FIG. 1 shows a schematic illustration of a hinge according to the invention.

The invention will be described hereinbelow with reference to a hinge 1 for a swing door, in particular a glass swing door. FIG. 1 shows a schematic illustration of the hinge 1. The hinge 1 has a first hinge part 2 and a second hinge part 3. The first hinge part 2 is designed for receiving the swing door. In order for it to be possible to retain a door leaf of the swing door, the first hinge part 2 has a clamping device. The clamping device comprises a first clamping unit 4 and a second clamping unit 5. A first elastic plastics-material protector 6 is arranged on an inner surface of the first clamping unit 4. Furthermore, a second elastic plastics-material protector 7 is arranged on an inner surface of the second clamping unit 5. The door leaf is retained with clamping action between the first clamping unit 4 and the second clamping unit 5. For this purpose, use is made, in addition, of clamping screws (not illustrated).

The second hinge part 3 is designed in the form of a hinge part which can be installed on a wall of a house or building or on a door frame. It has an installation unit 13, which can be fastened on the wall or the door frame by means of screws (not illustrated).

Furthermore, the second hinge part 3 has a first pin holder 8 and a second pin holder 9, between which an accommodating sleeve 10 of the first hinge part 2 is arranged. The accommodating sleeve 10 encloses a pin body 11, which has a hinge-pin element 12 (cf. FIG. 2). A first end of the hinge-pin element 12 is arranged on the first pin holder 8. More precisely, the first end of the hinge-pin element 12 is arranged in the first pin holder 8. A second end of the hinge-pin element 12 is arranged on the second pin holder 9. Once again more precisely, the second end of the hinge-pin element 12 is arranged in the second pin holder 9. Cross-pieces 14 of the first hinge part 2 project beyond the first pin holder 8 and the second pin holder 9 (cf. FIG. 1).

Figure 2:
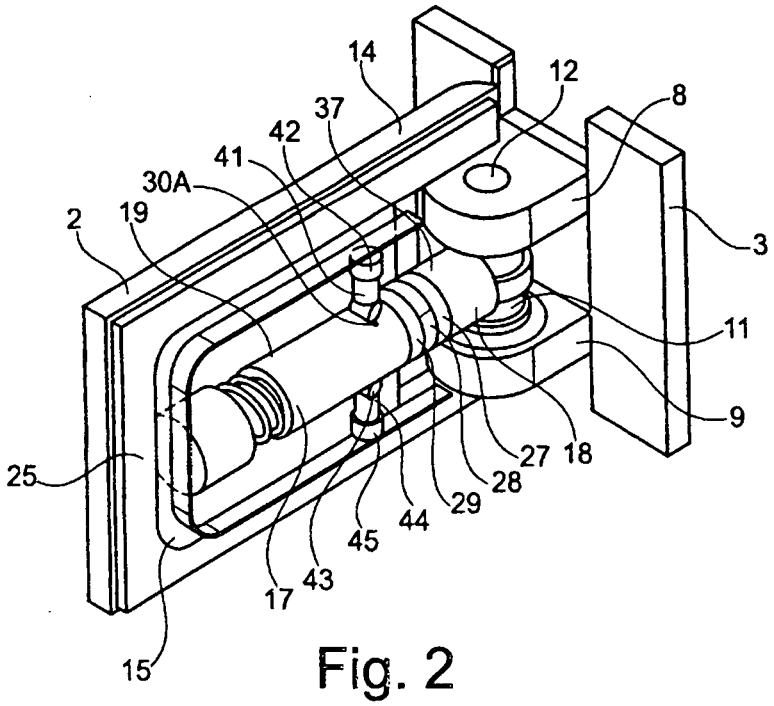
FIG. 2 shows a further schematic illustration of the hinge according to FIG. 1, this time in vertical elevation.
Figure 3:
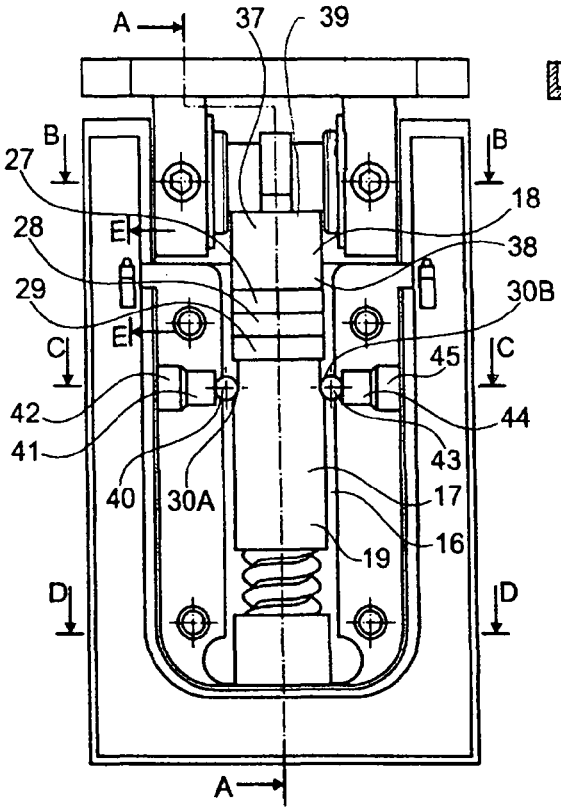
FIG. 3 shows the hinge in a lateral illustration, which is based on the illustration according to FIG. 2.
Figure 4:
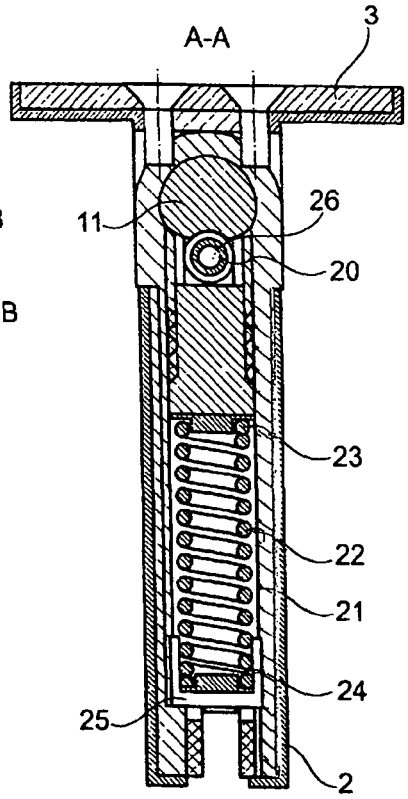
FIG. 4 shows a sectional view of the hinge taken along line A-A according to FIG. 3.
Figure 5:
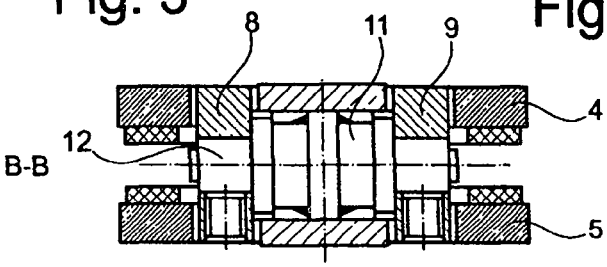
FIG. 5 shows a sectional view of the hinge taken along line B-B according to FIG. 3.
Figure 6:
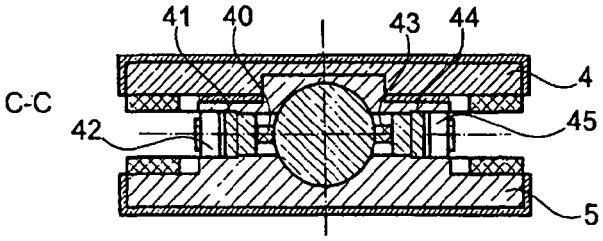
FIG. 6 shows a sectional view of the hinge taken along line C-C according to FIG. 3.
Figure 7:
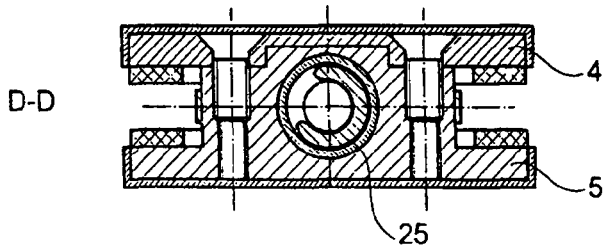
FIG. 7 shows a sectional view of the hinge taken along line D-D according to FIG. 3.
Figure 8:
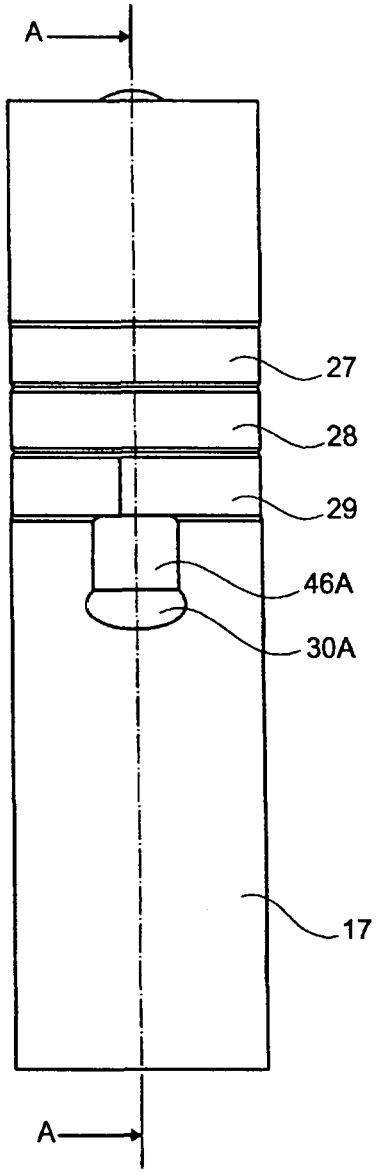
FIG. 8 shows a schematic side view of a piston unit.

The first hinge part 2 has a carrying body 15, which is illustrated schematically in FIG. 2. The carrying body 15 has formed in it a piston-unit holder 16 (cf. FIG. 3), in which a piston unit 17 is arranged in a displaceable manner. The piston unit 17 has a first piston-unit end 18 and a second piston-unit end 19. A latching body 20 is arranged at the first piston-unit end 18 (cf., in particular, FIGS. 4, 8 and 9), said latching body, in a latching position of the hinge 1, being arranged in a latching recess 26. The latching recess 26 is arranged on the pin body 11. A piston opening 21 is arranged at the second piston-unit end 19. A piston-spring element 22 in the form of a helical spring is arranged in the piston opening 21. The piston-spring element 22 has a first spring-element end 23 supported on the piston unit 17 at the end of the piston opening 21. A second spring-element end 24 is supported on a piston-adjusting unit 25. The piston-adjusting unit 25 is designed in the form of a screw which has an external thread and is arranged in a mating thread of the carrying body 15. Movement of the piston-adjusting unit 25 in the direction of the latching body 20 and movement of the piston-adjusting unit 25 in the direction counter to the latching body 20 makes it possible to adjust the force by which the latching body 20 is pushed into the latching recess 26. The force can be suitably adjusted, in particular, in dependence on the weight of the swing door such that the swing door is reliably retained in the latching position. Undesired release of the swing door from the latching position (for example by a gust of wind) is thus largely prevented, or at least made very difficult.

The piston unit 17 has a longitudinal axis. First of all the latching body 20, then a first arresting unit 27, then a second arresting unit 28, then a third arresting unit 29 and then grooves are arranged along the longitudinal axis of the piston unit 17, as seen from the first piston-unit end 18 in the direction of the second piston-unit end 19 (cf. in particular, FIGS. 2 through 9). The grooves comprise a first groove 30A and a second groove 30B.

Figure 9:
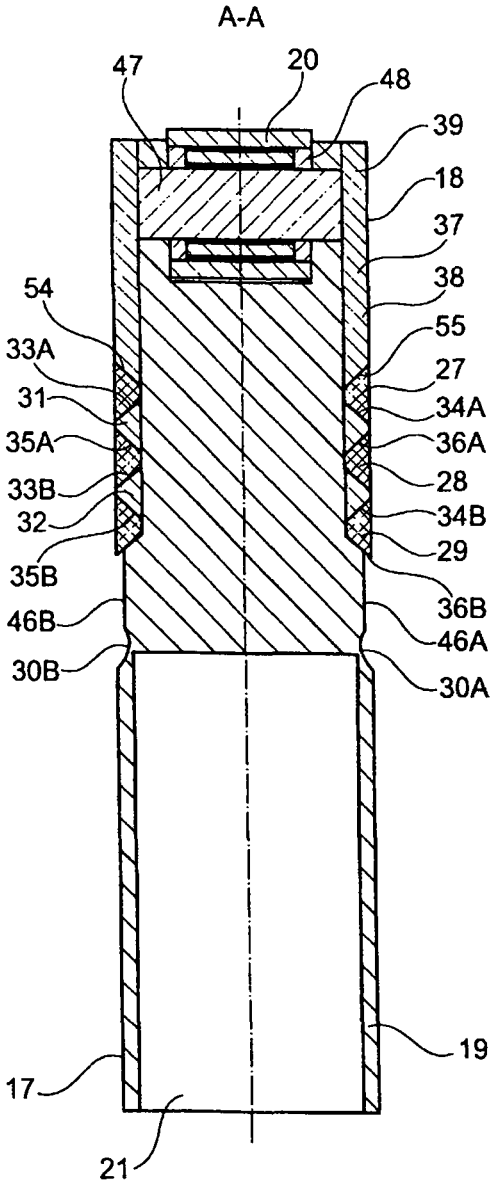
FIG. 9 shows a sectional view of the piston unit taken along line A-A according to FIG. 8.

As can be seen, in particular, from FIG. 9, the first arresting unit 27, the second arresting unit 28 and the third arresting unit 29 are arranged on an outer surface of the piston unit 17. The first arresting unit 27, the second arresting unit 28 and the third arresting unit 29 are designed in the form of a ring and are split.

A first separating element 31 is arranged between the first arresting unit 27 and the second arresting unit 28. Furthermore, a second separating element 32 is arranged between the second arresting unit 28 and the third arresting unit 29. Both the first separating element 31 and the second separating element 32 are designed in the form of rings.

The first separating element 31 has a first side, which is directed toward the first arresting unit 27. Furthermore, the first separating element 31 has a second side, which is directed toward the second arresting unit 28. A first abutment surface 33A is arranged on the first side of the first separating element 31. The first abutment surface 33A is arranged on a second abutment surface 34A of the first arresting unit 27. A third abutment surface 35A of a second side of the first separating element 31 butts against a fourth abutment surface 36A of the second arresting unit 28.

The same applies to the second separating element 32. The second separating element 32 has a first side, which is directed toward the second arresting unit 28. A first abutment surface 33B on the first side of the second separating element 32 butts against a second abutment surface 34B of the second arresting unit 28. Moreover, the second separating element 32 has a second side, which is directed toward the third arresting unit 29. A third abutment surface 35B on the second side of the second separating element 32 butts against a fourth abutment surface 36B of the third arresting unit 29.

The abutting abutment surfaces are designed to complement one another in each case. In particular, provision is made for the aforementioned abutment surfaces to be designed with a radius. In addition, or as an alternative, provision is made for the aforementioned abutment surfaces to be designed in the form of cones.

At the first piston-unit end 18, a sleeve 37 is arranged in a displaceable manner on the piston unit 17, in the region of the latching body 20. The sleeve 37 has a first sleeve end 38 and a second sleeve end 39. The first sleeve end 38 is operatively connected to the first arresting unit 27. The second sleeve end 39 is operatively connected to the pin body 11. The first sleeve end 38 has an abutment surface 54, which is oriented in the direction of the first arresting unit 27. This abutment surface 54 butts against an abutment surface 55 of the first arresting unit 27. The abutment surfaces 54 and 55 are designed to complement one another. They may be designed with a radius and/or in the form of cones.

As already mentioned above, the first groove 30A and the second groove 30B are arranged on the outer surface of the piston unit 17. As can be seen, in particular, from FIGS. 2 and 9, the first groove 30A and the second groove 30B are arranged diametrically opposite one another on the outer surface of the piston unit 17. The first groove 30A is followed by an essentially planar first pre-switching surface 46A, which extends from the first groove 30A to the third arresting unit 29. The second groove 30B is followed by an essentially planar second pre-switching surface 46B, which extends from the second groove 30B to the third arresting unit 29.

The first groove 30A has arranged in it a first pressure-exerting unit 40, on which is arranged, in turn, a first elastic intermediate element 41. Moreover, a first adjusting unit 42 is arranged on the first elastic intermediate element 41 (cf., in particular, FIGS. 2, 3 and 6). The first adjusting unit 42 is designed in the form of a screw and is arranged in a thread in the carrying body 15. The first pressure-exerting unit 40 is of cylindrical design and, in addition, is formed from stainless steel. The first elastic intermediate element 41 is formed from an elastic plastics material. The elasticity of the first elastic intermediate element 41 is selected such that, on the one hand, it is possible to achieve a slight movement of the first pressure-exerting unit 40 relative to the piston unit 17. On the other hand, the elasticity is selected such that the piston unit 17 is reliably retained in the piston-unit holder 16. The first adjusting unit 42 makes it possible to adjust a force by which the first pressure-exerting unit 40 is arranged in the first groove 30A. This makes it possible to adjust the intensity of the braking action and thus the braking force during movement of the swing door.

The second groove 30B has arranged in it a second pressure-exerting unit 43, on which is arranged, in turn, a second elastic intermediate element 44. Moreover, a second adjusting unit 45 is arranged on the second elastic intermediate element 44 (cf., in particular, FIGS. 2, 3 and 6). The second adjusting unit 45 is designed in the form of a screw and is arranged in a thread in the carrying body 15. The second pressure-exerting unit 43 is likewise of cylindrical design and, in addition, is likewise formed from stainless steel. The second elastic intermediate element 44 is formed from an elastic plastics material. The elasticity of the second elastic intermediate element 44 is selected such that, on the one hand, it is possible to achieve a slight movement of the second pressure-exerting unit 43 relative to the piston unit 17. On the other hand, the elasticity is selected such that the piston unit 17 is reliably retained in the piston-unit holder 16. The second adjusting unit 45 makes it possible to adjust a force by which the second pressure-exerting unit 44 is arranged in the second groove 30B. This makes it possible to adjust the intensity of the braking action and thus the braking force during movement of the swing door.

As can be seen, in particular, from FIG. 9, the latching body 20 has a first end and a second end. Furthermore, the latching body 20 is provided with an opening 48, which extends from the first end to the second end. A pin element 47 is arranged in the opening 48. The pin element 47 projects both out of the first end and out of the second end. The latching body 20 is arranged on the piston unit 17 by means of the pin element 47.

Figure 10:
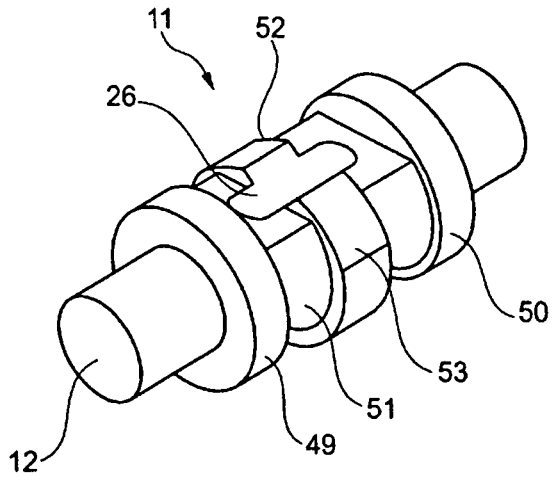
FIG. 10 shows a schematic illustration of a pin body.
Figure 11:
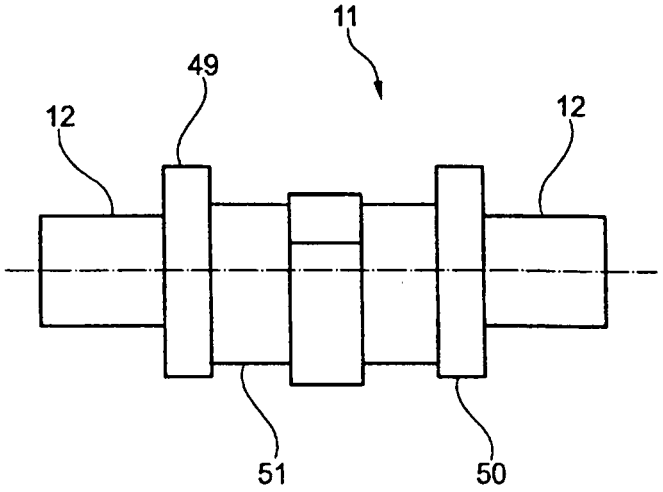
FIG. 11 shows a schematic side view of the pin body according to FIG. 10.

FIG. 10 shows a schematic illustration of the pin body 11. Furthermore, FIG. 11 shows a schematic side view of the pin body 11. As already explained above, the pin body 11 has the hinge-pin element 12, which extends from the pin body 11. A central crosspiece 51, on which the latching recess 26 is formed, is arranged between a first ring element 49 and a second ring element 50. The pin body 11 has, on its central crosspiece 51, a first control surface 52, which is adjacent to the latching recess 26. Also arranged on the central crosspiece 51 is a second control surface 53, which is likewise adjacent to the latching recess 26. The first control surface 52 and the second control surface 53 are arranged opposite one another on the central crosspiece 51 of the pin body 11 such that the latching recess 26 is arranged between the first control surface 52 and the second control surface 53. Both the first control surface 52 and the second control surface 53 are spaced apart further in the radial direction from the longitudinal axis of the pin body 11 than a minimum distance between the latching recess 26 and the longitudinal axis of the pin body 11.

The hinge 1 has two active units. In the case of the embodiment illustrated in the figures, the first active unit comprises both the arresting units 27 to 29 and the sleeve 37. During movement of the swing door, for example, from an open position into a closed position, the sleeve 37, in the region adjacent to the latching position, and/or when the latching position is reached, is displaced along the longitudinal axis of the piston unit 17 in a direction away from the latching recess 26. In other words, the sleeve 37 is displaced in the direction of the first arresting unit 27. On account of the interaction of the sleeve 37, of the arresting units 27 to 29 and of the separating elements 31 and 32, the arresting units 27 to 29 are moved in the radial direction away from the longitudinal axis of the piston unit 17, to be precise in the direction of the surface of the piston-unit holder 16. The arresting units 27 to 29 thus position themselves against the surface of the piston-unit holder 16. This achieves, in particular, two effects. On the one hand, the abutment and the interaction of the arresting units 27 to 29 with the surface of the piston-unit holder 16 achieves the situation where movement of the swing door, for example movement in the direction of a closed position, is braked. On the other hand, the closed position of the swing door is reliably retained.

The second active unit is formed by the aforementioned pressure-exerting units 40 and 43, by the elastic intermediate elements 41 and 44 and by the adjusting units 42 and 45. Said second active unit likewise serves for braking movement of the swing door and basically enhances the braking action of the first active unit.

The features of the invention which are disclosed in the present description, in the drawings and in the claims may be essential both individually and in any desired combinations for the purpose of realizing the various embodiments of the invention.

REFERENCE SIGNS

1 Hinge
2 First hinge part

3 Second hinge part
4 First clamping unit
5 Second clamping unit
6 First elastic plastics-material protector
7 Second elastic plastics-material protector
8 First pin holder
9 Second pin holder
10 Accommodating sleeve
11 Pin body
12 Hinge-pin element of the pin body
13 Installation unit
14 Crosspieces
15 Carrying body
16 Piston-unit holder
17 Piston unit
18 First piston-unit end
19 Second piston-unit end
20 Latching body
21 Piston opening
22 Piston-spring element
23 First spring-element end
24 Second spring-element end
25 Piston-adjusting unit
26 Latching recess
27 First arresting unit
28 Second arresting unit
29 Third arresting unit
30A First groove
30B Second groove
31 First separating element
32 Second separating element
33A First abutment surface
33B First abutment surface
34A Second abutment surface
34B Second abutment surface
35A Third abutment surface
35B Third abutment surface
36A Fourth abutment surface
36B Fourth abutment surface
37 Sleeve
38 First sleeve end
39 Second sleeve end
40 First pressure-exerting unit
41 First elastic intermediate element
42 First adjusting unit
43 Second pressure-exerting unit
44 Second elastic intermediate element
45 Second adjusting unit
46A First pre-switching surface
46B Second pre-switching surface
47 Pin element
48 Opening in the latching body
49 First ring element
50 Second ring element
51 Central crosspiece
52 First control surface
53 Second control surface
54 Abutment surface of the sleeve
55 Further abutment surface of the first arresting unit

The invention claimed is:

1. A hinge for a partition element, having
at least a first hinge part,
at least a second hinge part, wherein the first hinge part and the second hinge part are pivotably connected around at least one hinge-pin unit, and having
at least one latching device wherein the latching device has at least one latching body and at least one latching recess, wherein the latching body is arranged on the first hinge part, wherein the latching recess is arranged on the circumference of a pin body of the second hinge part, and wherein, in a latching position of the hinge, the latching body engages in the latching recess,
wherein
the latching body is arranged on a piston unit,
the piston unit is arranged in a movable manner in a piston-unit holder of the first hinge part,
at least one arresting unit is arranged on the piston unit,
the arresting unit is designed for movement in a direction of a surface of the piston-unit holder such that the arresting unit interacts with the surface of the piston-unit holder,
at least one groove is arranged on the piston unit,
at least one pressure-exerting unit is arranged in the groove, and wherein
at least one adjusting unit is arranged on the pressure-exerting unit such that it is possible to adjust a force by which the pressure-exerting unit is arranged in the groove.

2. The hinge as claimed in claim 1, wherein
the piston unit has a first piston-unit end and a second piston-unit end,
the latching body is arranged at the first piston-unit end,
at least one piston opening is arranged at the second piston-unit end,
at least one piston-spring element is arranged in the piston opening, and wherein
the piston-spring element has a first spring-element end supported on the piston unit and a second spring-element end supported on a piston-adjusting unit.

3. The hinge as claimed in claim 2, wherein
the piston unit has a longitudinal axis, and wherein
first of all the latching body, then the arresting unit and then the groove are arranged on the piston unit along the longitudinal axis, as seen from the first piston-unit end in the direction of the second piston-unit end.

4. The hinge as claimed in claim 1, wherein
a sleeve is arranged in a displaceable manner on the piston unit,
the sleeve has a first sleeve end and a second sleeve end,
the first sleeve end is operatively connected to the arresting unit, and wherein
the second sleeve end is operatively connected to the pin body.

5. The hinge as claimed in claim 1, wherein the hinge has at least one of the following features:
the pressure-exerting unit is of cylindrical design; or
the pressure-exerting unit is formed from stainless steel.

6. The hinge as claimed in claim 1, wherein at least one elastic intermediate element is arranged between the pressure-exerting unit and the adjusting unit.

7. The hinge as claimed in claim 1, wherein
the pressure exerting unit is designed in the form of a first pressure-exerting unit,
the adjusting unit is designed in the form of a first adjusting unit,
the groove is designed in the form of a first groove,
a second groove is arranged on the piston unit,
at least a second pressure-exerting unit is arranged in the second groove, and wherein
at least a second adjusting unit is arranged on the second pressure-exerting unit such that it is possible to adjust a force by which the second pressure-exerting unit is arranged in the second groove.

8. The hinge as claimed in claim 1, wherein
the arresting unit is arranged on an outer surface of the piston unit, and wherein
the arresting unit is designed in the form of a split ring.

9. The hinge as claimed in claim 1, wherein
the arresting unit is designed in the form of a first arresting unit,
at least a second arresting unit is arranged on the piston unit, and wherein
the second arresting unit is designed for movement such that the second arresting unit interacts with the surface of the piston-unit holder.

10. The hinge as claimed in claim 9, wherein
at least one separating element is arranged between the first arresting unit and the second arresting unit,
the separating element has at least a first side, which is directed toward the first arresting unit,
a first abutment surface is arranged on the first side of the separating element,
the first abutment surface butts against a second abutment surface of the first arresting unit,
the separating element has at least a second side, which is directed toward the second arresting unit,
a third abutment surface is arranged on the second side of the separating element, and wherein
the third abutment surface butts against a fourth abutment surface of the second arresting unit.

11. The hinge as claimed in claim 10, wherein
the first abutment surface and the second abutment surface are designed to complement one another, and/or wherein
the third abutment surface and the fourth abutment surface are designed to complement one another.

12. The hinge as claimed in claim 10, wherein one or more of the abutment surfaces are in the form of
a radius or
a cone.

13. The hinge as claimed in claim 9, wherein one or more of the arresting units are
in the form of a split ring.

14. The hinge as claimed in claim 1, wherein the latching body, in the latching position of the hinge, engages resiliently in the latching recess.

15. The hinge as claimed in claim 1, wherein
the latching body has a first end and a second end,
the latching body has an opening,
the opening extends from the first end to the second end,
a pin element is arranged in the opening, and wherein
the pin element projects both out of the first end and out of the second end.

16. The hinge as claimed in claim 15, wherein the pin element is arranged on the piston unit.

17. The hinge as claimed in claim 1, wherein the pin body is arranged on the at least one hinge-pin unit.

18. The hinge as claimed in claim 1, wherein
the pin body has at least one first control surface,
the latching recess is adjacent to the at least one first control surface, and wherein
the at least one first control surface is spaced apart further in the radial direction from a longitudinal axis of the pin body than a minimum distance between the latching recess and the longitudinal axis of the pin body.

19. The hinge as claimed in claim 18, wherein
the pin body has a second control surface,
the latching recess is adjacent to the second control surface, and wherein
the at least one first control surface and the second control surface are arranged opposite one another on the pin body such that the latching recess is arranged between the at least one first control surface and the second control surface.

20. A partition-element system having at least one partition element and having at least one hinge as claimed in claim 1.

21. The partition-element system as claimed in claim 20, wherein the partition element is designed in the form of a swing door.

22. The hinge as claimed in claim 1, wherein the second hinge part is arranged on a wall.

* * * * *